US005520202A

United States Patent [19]

Arbree

[11] Patent Number: 5,520,202

[45] Date of Patent: May 28, 1996

[54] COSMETIC KIT

[76] Inventor: Laura Arbree, 420 Palm Cir. E., Naples, Fla. 33940

[21] Appl. No.: 237,141

[22] Filed: May 3, 1994

[51] Int. Cl.[6] ..... A45D 33/26

[52] U.S. Cl. ..... 132/294; 132/293; 132/148

[58] Field of Search ..... 132/286, 290, 132/293, 294, 297, 298, 313, 314, 317, 148, 315, 297; 206/581, 823

[56] References Cited

U.S. PATENT DOCUMENTS

| | | | |
|---|---|---|---|
| 1,710,661 | 4/1929 | Hines . | |
| 1,760,778 | 5/1930 | Ries . | |
| 2,097,934 | 11/1937 | Morrison | 132/313 |
| 2,163,429 | 6/1939 | Kaplan . | |
| 4,336,815 | 6/1982 | Ross . | |
| 4,369,799 | 1/1983 | Napoleon | 132/294 |
| 4,421,127 | 12/1983 | Geer | 132/294 |
| 4,716,915 | 6/1988 | Burns . | |
| 5,012,831 | 5/1991 | Canela | 132/313 |
| 5,107,871 | 4/1992 | Butcher et al. | 132/293 |
| 5,163,456 | 11/1992 | Lombardi | 132/103 |
| 5,320,125 | 6/1994 | Barnhart | 132/313 |

*Primary Examiner*—John G. Weiss
*Attorney, Agent, or Firm*—Merrill N. Johnson

[57] ABSTRACT

A thin, flat miniature cosmetic kit made of plastic and designed to hold in separate compartments a one-day supply of perfume, lipstick and face powder and an applicator for the cosmetics. The cosmetic kit has a self-locking cover which when closed prevents the scattering or loss of the cosmetics when the kit is closed and locked.

6 Claims, 1 Drawing Sheet

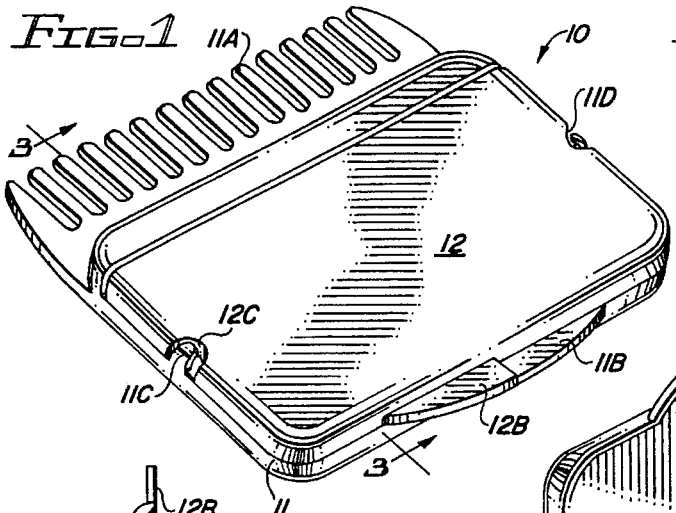
FIG. 1
11A
10
11D
3
12
12C
11C
11B
12B
3
11
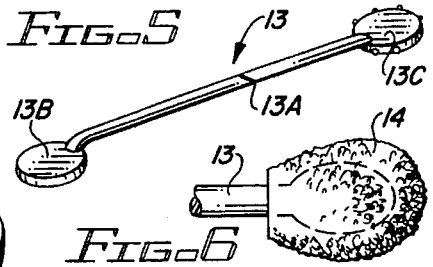
FIG. 5
13
13C
13B
13A
14
13
FIG. 6
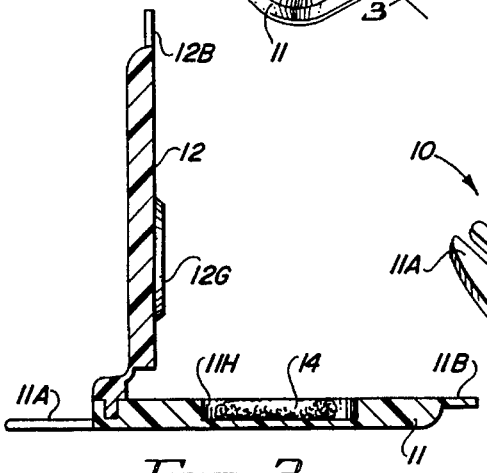
12B
12
12G
11H
14
11B
11A
11
FIG. 3
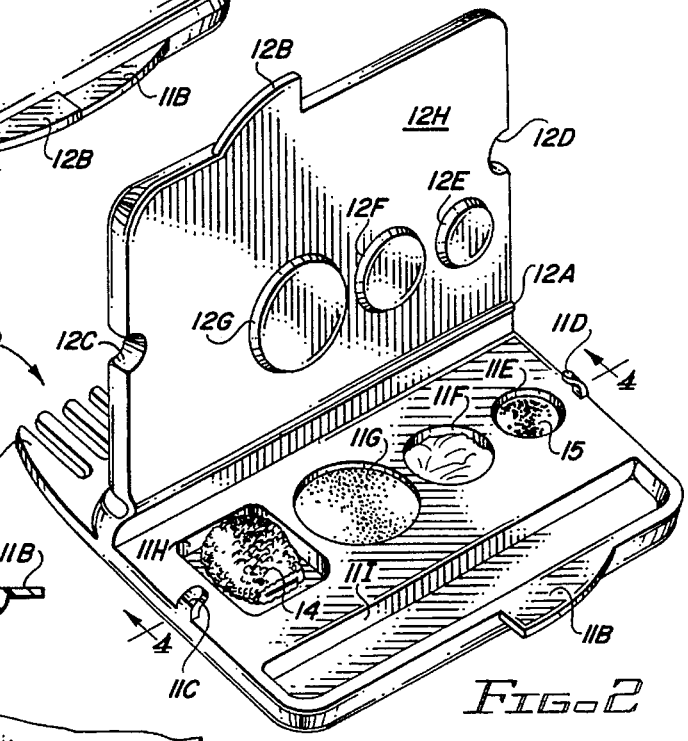
12B
12H
12D
12E
12F
12A
12G
11D
10
12C
4
11E
11F
11G
15
11A
11H
11I
14
11B
4
11C
FIG. 2
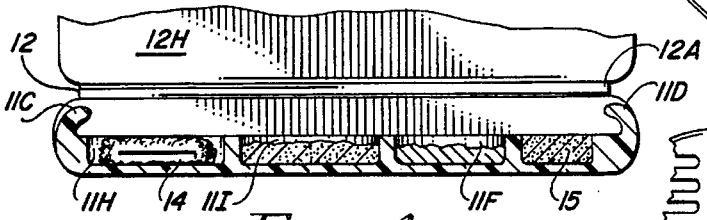
12
12H
12A
11C
11D
11H
14
11I
11F
15
FIG. 4
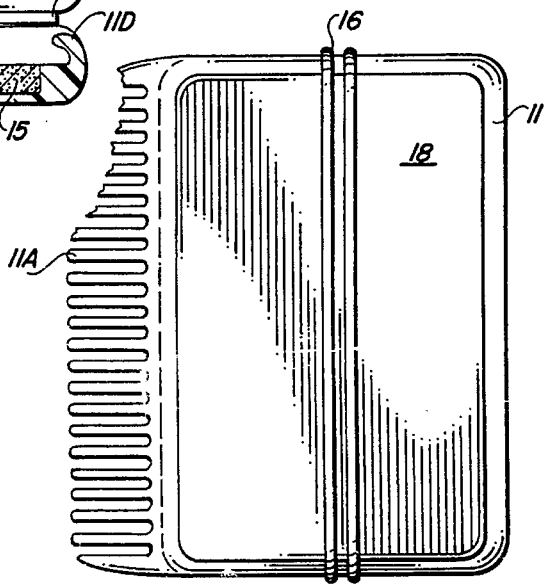
16
11
18
11A
FIG. 8
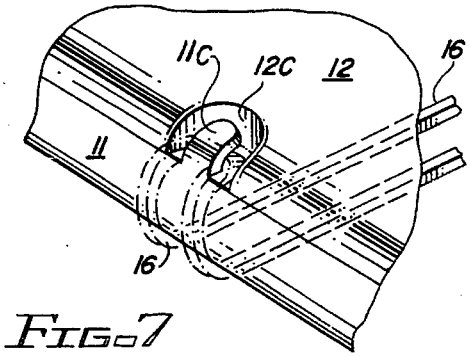
11C
12C
12
16
11
16
FIG. 7

COSMETIC KIT

BACKGROUND OF THE INVENTION

My invention lies in the field of containers or kits principally used by women in the application of cosmetics such as face powder, lipstick and perfume. More precisely my invention is a very small kit containing a one day supply of face powder, lipstick or lip rouge and perfume, an applicator for the powder and lipstick, and a comb for the hair.

Manufacturers traditionally package their cosmetics in quantities which permit a considerable number of applications of the particular cosmetic—a carton of face powder, a tube of lipstick, a bottle of perfume. To meet the growing demand by busy women, particularly women in business, for a kit containing small quantities of several cosmetics which can be carried in a purse or handbag, containers are presently on the market made of metal, plastic, glass or a combination of these materials ranging in length from 4 to 5 inches and width from 1.5 to 2 inches weighing several ounces.

To apply the cosmetics contained in these kits requires opening and closing several different compartments, adding considerable time to the application of the cosmetics. Moreover, these kits are quite expensive and have the added disadvantages of being too heavy to carry in a pocket and taking considerable space in a purse or handbag. Lastly, the kits on the market do not always contain the particular shade of powder and/or lipstick desired by a potentail customer.

SUMMARY OF THE INVENTION

I have invented a miniature cosmetic kit that gives a woman burden free mobility without giving up her essential cosmetics. My kit can easily be carried in the pocket of a dress or jacket or in the woman's underclothing. Moreover, a credit card, a few folded bills or a key can be removably attached to the underside of the kit.

Preferably my kit is constructed from two separately molded plastic pieces, namely a base and a cover permanently joined together by heat or glue. The cover contains a living hinge and in the kit's closed position, the cover is locked into position by a pair of interlocking flanges on the front edge of the kit which can be snapped open by a twist of the user's thumb and index finger.

When opened, the base of the kit contains cylindrical recesses or receptacles, one for face powder, one for lipstick or lip rouge, and one containing a small disk of absorbant material containing a drop or two of perfume. In addition the kit contains an elongated recess which houses a two-ended applicator, one end spatula shaped for the application of lipstick or rouge, and the other end enlarged and flattened to receive a mitten shaped powder puff which is also housed in a fourth recess or receptacle in the base of the kit.

The lower inside surface of the kit's cover includes three generally cylindrical plugs or "corks" which when the cover is closed fit over the three cylindrical recesses or receptacles housing the powder, lipstick and perfume.

Molded into the opposite edges of the kit's base are a pair of inwardly curved hooks. Cooperatively, indentations are molded into the cover to provide clearance for the upwardly projecting hooks. By stretching a rubber band in tension between the hooks and against the lower surface of the kit's base, a credit card, folded bills or a key can be safely stored against the surface of the kit.

A toothed comb for the hair is also molded into and forms a part of the base of the kit. With the cover closed, the closed kit becomes a convenient handle for the comb.

In its most convenient form, the kit is about 3.5 inches in length, about 2.5 inches wide not counting the comb, and not more than one half inch thick and preferably less than 0.3 inches thick. As marketed, the kit includes the applicator and powder puff, but does not contain powder, lipstick or perfume. Instead, the woman adds to the kit a small quantity of powder, a dab of lipstick or lip rouge and a drop or two of her perfume for the day and tucks the kit into her bra or a pocket before leaving her dressing room without visible baggage for a busy day. This leaves her arms, shoulders and hands free to hold a glass, an appetizer or a child without a pocketbook or handbag in the way.

BRIEF DESCRIPTION OF THE DRAWINGS

The appended drawings depict a preferred embodiment of my miniature cosmetic kit in which FIG. 1 is a perspective view taken from above of my cosmetic kit with its cover closed;

FIG. 2 is a further perspective view of my kit with its cover open showing its contents ready to be used;

FIG. 3 is a cross-sectional view taken along line 3—3 of FIG. 1 with the kit's lid in open position;

FIG. 4 is a further cross-sectional view partially broken away and taken along line 4—4 of FIG. 2;

FIG. 5 is a perspective view of the cosmetic applicator carried in the kit;

FIG. 6 is a detailed view of the powder puff mounted on one end of the applicator shown in FIG. 5;

FIG. 7 is a detailed view of the side of the kit showing a rubber band fastened over the hooks in the kit's base; and FIG. 8 is a plan view of the bottom of the kit showing a credit card secured by a rubber band to the bottom of the kit.

DETAILED DESCRIPTION OF THE PREFERRED EMBODIMENT

Referring to FIGS. 1 thru 4 of the drawings, my miniature cosmetic kit 10 consists of two separately molded plastic pieces, base 11 and cover 12, bonded together by heat and/or glue as best shown in FIG. 3.

Cover 12 includes a living hinge 12A best shown in FIG. 2. In kit 10's closed position (FIG. 1) cover 12 is locked into position against base 11 by a pair of interlocking flanges 11B and 12B projecting from the front edge respectively of base 11 and cover 12 as shown in FIG. 1. Kit 10 can be opened by a twist of a person's thumb and index finger.

As shown in its opened position (FIG. 2) base 11, contains five recesses or receptacles 11E, 11F, 11G, 11H and 11I. Cylindrical recess 11E contains a disc 15 of absorbant material which is designed to receive a drop or two of perfume. Cylindrical recess 11F is designed to receive a small dab of lipstick or lip rouge. Cylindrical recess 11G is designed to receive a small quantity of face powder.

In addition to recesses 11E, F and G designed to house cosmetics, base 11, includes a rectangular recess 11H containing a mitten-shaped powder puff 14 and an elongated recess 11I housing a cosmetic applicator 13.

In order to contain perfume disc 15, the dab of lipstick and the face powder within their respective receptacles when the kit's cover 12 is closed and the kit is transported during the day on the woman's person, cover 12 includes three generally cylindrical corks or plugs 12E, 12F and 12G projecting from the flat lower surface 12H of cover 12 and designed to fit into the upper edge respectively of recesses 11E, 11F and 11G when cover 12 is closed and locked.

Molded into the opposite edges of kit base 11 are a pair of upwardly projecting and inwardly curved hooks 11C and 11D. In order to provide clearance for hooks 11C and 11D, cover 12 includes two similar indentations 12C and 12D best shown in FIG. 2. If desired, a rubber band 16 can be stretched under tension between hooks 11C and 11D and across the lower surface of base 11. A credit card 18, a drivers license and/or a number of folded bills may be securely but removably stored under rubber band 16 for use during the day.

As shown in FIGS. 5 and 6, applicator 13 has at its midpoint an indentation or groove 13A which enables applicator 13 to be easily broken into two separate cosmetic applicators—one having a spatula-shaped end 13B for applying lipstick and the other with its flat rounded end 13C designed to receive and retain mitten-shaped powder puff 14 for applying powder from recess 11G.

A toothed comb 11A is molded into the back side of base 11 with the teeth of the comb pointing away from the covered portion of the kit. With the cover closed and locked, the closed kit serves as a convenient handle for comb 11A.

My miniature cosmetic kit 10 is 3.5 inches in length, 2.5 inches in width not counting comb 11A, and not more than 0.5 inches thick and preferably less than 0.3 inches thick.

While I have shown and described a preferred form of my cosmetic kit, changes and modifications will be apparent to those skilled in the art. However, no limitations should be inferred from the foregoing description of my invention whose scope is limited only by the appended claims.

I claim:

1. A miniature cosmetic kit comprising:

a rectangular molded plastic base having a front edge, rear edge and two shorter side edges, said base having an interior with three cylindrical recesses for storage of three different cosmetics, said interior of said base also including an elongated rectangular recess for holding a cosmetic applicator, a cover having a front and rear edge and connected to said base by an elongated living hinge along said rear edge of the cover and base, said cover having an interior surface facing the interior surface of the base when the cosmetic kit is in a closed position, said interior surface of the cover having three cylindrical plugs that are positioned to fit into the three recesses of the base to prevent the loss or scattering of the cosmetics when the cosmetic kit is in a closed position, a means for locking the cover to said base in a closed position, said means for locking extending along the front edge of the cover and base, said base including a comb projection outwardly from rear edge of the base to allow for the combing of hair by the cosmetic kit.

2. A miniature cosmetic kit as set forth in claim 1, in which the means for locking the cover to the base includes a flange projecting from the front edge of the base and a flange projecting from the front edge of the cover, said flanges interlock together and are opened by the twisting of the flanges relative to one another by the user.

3. A miniature cosmetic kit as set forth in claim 1, in which the base includes an upwardly extending projecting hook centered on an outer surface of the two shorter sides of the base, a rubber band stretched over and between the two hooks to allow the user to secure a credit card or other flat object against the surface of the cosmetic kit.

4. A miniature cosmetic kit comprising:

a rectangular molded plastic base having a front edge, rear edge and two shorter side edges, said base having an interior with three cylindrical recesses for storage of three different cosmetics, said interior of said base also including an elongated rectangular recess for holding a cosmetic applicator and a second rectangular recess for storing a powder puff, a cover having a front and rear edge and connected to said base by bonding an elongated living hinge of the cover to said rear edge of the base, said cover having an interior surface facing the interior surface of the base when the cosmetic kit is in a closed position, said interior surface of the cover having three cylindrical plugs that are positioned to fit into the three recesses of the base to prevent the loss or scattering of the cosmetics when the cosmetic kit is in a closed position, a means for locking the cover to said base in a closed position, said means for locking extending along the front edge of the cover and base, said base including a comb projection outwardly from rear edge of the base to allow for the combing of hair by the cosmetic kit, the means for locking the cover to the base includes a flange projecting from the front edge of the base and a flange projecting from the front edge of the cover, said flanges interlock together and are opened by the twisting of the flanges relative to one another by the user.

5. A miniature cosmetic kit as set forth in claim 4, in which the base includes an upwardly extending projecting hook centered on an outer surface of the two shorter sides of the base, a rubber band stretched over and between the two hooks to allow the user to secure a credit card or other flat object against the surface of the cosmetic kit.

6. A miniature cosmetic kit as set forth in claim 4, having an overall length of 3.5 inches and an width, less the comb, of 2.5 inches, an overall height of less than 0.3 inches.

* * * * *